US005136997A

United States Patent [19]

Takahashi et al.

[11] Patent Number: 5,136,997

[45] Date of Patent: Aug. 11, 1992

[54] IDLE SPEED CONTROL APPARATUS FOR AN INTERNAL COMBUSTION ENGINE

[75] Inventors: Minoru Takahashi; Kiyoshi Yagi, both of Kobe, Japan

[73] Assignee: Fujitsu Ten Limited, Hyogo, Japan

[21] Appl. No.: 575,648

[22] Filed: Aug. 31, 1990

[30] Foreign Application Priority Data

Aug. 31, 1989 [JP] Japan ..... 1-226701

[51] Int. Cl.[5] ..... F02D 41/16

[52] U.S. Cl. ..... 123/339

[58] Field of Search ..... 123/339

[56] References Cited

U.S. PATENT DOCUMENTS

| | | | |
|---|---|---|---|
| 3,964,457 | 6/1976 | Coscia | 123/339 |
| 4,381,746 | 5/1983 | Miyagi et al. | 123/339 |
| 4,557,234 | 12/1985 | Ito | 123/339 |
| 4,879,983 | 11/1989 | Shimomura et al. | 123/339 |
| 4,986,236 | 1/1991 | Kobayashi | 123/339 |

FOREIGN PATENT DOCUMENTS

| | | | |
|---|---|---|---|
| 62-13749 | 1/1987 | Japan . | |
| 0013752 | 1/1987 | Japan | 123/339 |
| 63-150447 | 6/1988 | Japan . | |
| 1-195943 | 8/1989 | Japan . | |
| 0271631 | 10/1989 | Japan | 123/339 |
| 2113429 | 8/1983 | United Kingdom | 123/339 |

*Primary Examiner*—Tony M. Argenbright

*Attorney, Agent, or Firm*—Wenderoth, Lind & Ponack

[57] ABSTRACT

When a fluctuation of engine speed is detected during idling of an engine, an opening degree of the flow control valve provided in an idle bypass pipe is changed at a comparatively high rate of change. Based upon this, when the rate of change of the engine speed approaches zero, it rapidly changes the opening degree to maintain a value related to intake pipe pressure or an accumulated value of the intake pipe pressure and the engine speed at that point, or until the value is reached at a range which a gentle change is possible. Consequently, for example, when the engine speed drops, the intake air flow is increased at a comparatively high rate of change, and it is possible to prevent engine stalling. Further more, when the rate of change of the engine speed passes through zero and begins to rise, the intake air flow is rapidly reduced until the value is reached the range at which the torque at that point can be maintained, and so called quick response due to overcontrol is prevented. In this way, with a high control gain, it performs idle speed control having more favorable stability.

4 Claims, 9 Drawing Sheets

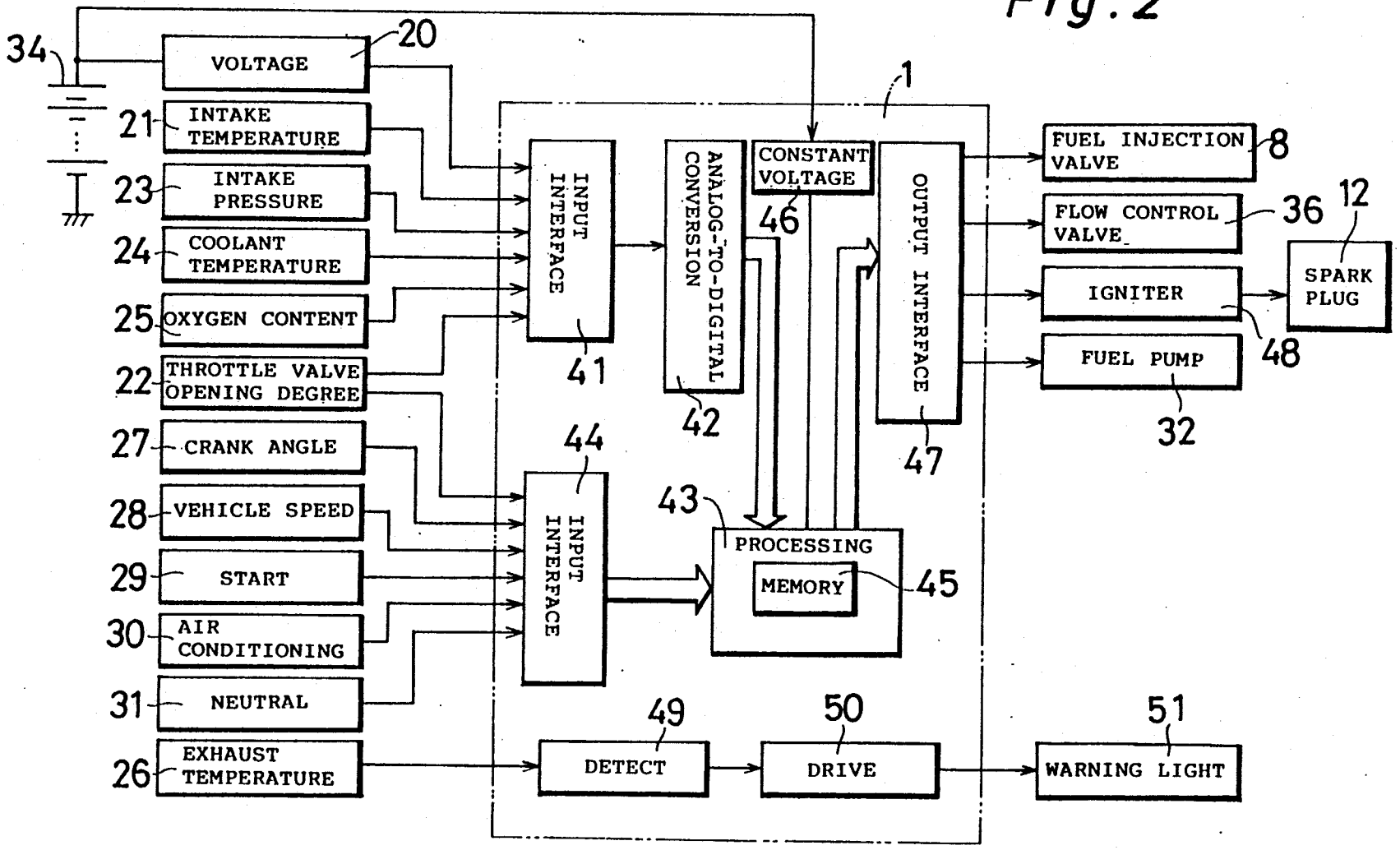
Fig. 2
SPARK PLUG
12
FUEL INJECTION VALVE
8
FLOW CONTROL VALVE
36
IGNITER
48
FUEL PUMP
32
WARNING LIGHT
51
OUTPUT INTERFACE
47
1
CONSTANT VOLTAGE
46
PROCESSING
MEMORY
45
43
DRIVE
50
ANALOG-TO-DIGITAL CONVERSION
42
INPUT INTERFACE
41
INPUT INTERFACE
44
DETECT
49
VOLTAGE
20
INTAKE TEMPERATURE
21
INTAKE PRESSURE
23
COOLANT TEMPERATURE
24
OXYGEN CONTENT
25
THROTTLE VALVE OPENING DEGREE
22
CRANK ANGLE
27
VEHICLE SPEED
28
START
29
AIR CONDITIONING
30
NEUTRAL
31
EXHAUST TEMPERATURE
26
34

IDLE SPEED CONTROL APPARATUS FOR AN INTERNAL COMBUSTION ENGINE

BACKGROUND OF THE INVENTION

1. Field of the Invention

The present invention relates to an apparatus for controlling an idle speed of an internal combustion engine.

2. Description of the Prior Art

In internal combustion engines, at the time of idling when the generated torque is small, the engine speed as a rotating speed of a crank shaft fluctuates with a slight load fluctuation. For example, the engine speed drops at times such as when there is a power load from audio devices, or an air conditioner or the like is turned on, as well as at such times as during steering without driving of a power steering unit or when an automatic transmission is shifted into a Drive range.

On the other hand, in recent years, idle speed has been kept comparatively low due to increased fuel costs, and consequently there is a danger of causing engine stalling in cases where there is overlapping of the main causes which produce load fluctuations, such as those mentioned above.

Because of this, in the typical prior art, the control apparatus which controls an opening degree of the flow control valve provided in an idle bypass pipe takes in the output of the various devices which are the main causes of load fluctuation and the detection results of sensors or the like, and, for example, when the air conditioner is being used, sets a target engine speed when idling of just 250 rpm higher. So as to attain the target engine speed established in this way, together with the adding of a predetermined opening degree for each load to the basic opening degree, an integral control is performed so that the established opening degree will be attained with a small control gain in order to curtail overcontrol.

In prior art such as that mentioned above, since it is necessary for the control apparatus to take in the output from the various devices and the detection results of the sensors or the like, the construction is complicated and the cost rises. Furthermore, since the control gain is low, the responsiveness is inferior and a long time interval is needed to reach the target engine speed. On the other hand, when the control gain is increased, responsiveness improves but stability is inferior. In other words, excesses of control occur leading to overcontrol, and undesirable situations such as so called hunting and quick response are brought about.

SUMMARY OF THE INVENTION

Therefore, in order to solve the above problems, the object of the invention is to present a novel and improved idle speed control apparatus for internal combustion engine.

Another object of the invention is to present an idle speed control apparatus for internal combustion engine in which both the simplification of construction and the coexistence of responsiveness and stability are possible.

In order to accomplish the above objects, an idle speed control apparatus for an internal combustion engine conforming to the invention that links an upstream side and a downstream side of a throttle valve with an idle bypass pipe, and maintains the engine speed at a predetermined target speed by changing an opening degree of the flow control valve provided in the idle bypass pipe is arranged such that:

when a drop or rise of the engine speed is detected, it increases or decreases the opening degree at a comparatively high rate of change;

at the point that the rate of change of the engine speed becomes zero or nearly zero, it rapidly decreases or increases the opening degree to maintain a value related to an intake pipe pressure or an accumulated value of the intake pipe pressure and the engine speed at that point, or until the value is reached at a range in which a gentle change is possible.

In the preferred embodiment, the idle speed control apparatus for an internal combustion engine is arranged such that increasing or decreasing control of the opening degree due to the detection of the drop or rise of the engine speed is performed at the time the engine speed is near the target speed and lower than a predetermined first value which is higher than the target speed when the engine speed drops, and the control is performed at the time the engine speed is near the target speed and higher than a predetermined second value which is lower than the target speed when the engine speed rises.

In accordance with the present invention, when a comparatively large fluctuation of engine speed is detected during idling of the engine, the opening degree of the flow control valve provided in the idle bypass pipe is changed at a comparatively high rate of change. Based upon this, when the rate of change of the engine speed approaches zero, it rapidly changes the opening degree to maintain the value related to the intake pipe pressure or the accumulated value of the intake pipe pressure and the engine speed at that point, or until the value is reached at a range in which a gentle change is possible.

Consequently, for example, when the engine speed drops, the intake air flow is increased at a comparatively high rate of change, and it is possible to prevent engine stalling. Furthermore, when the rate of change of the engine speed passes through zero and begins to rise, the intake air flow is rapidly reduced until the value is reached at the range in which the torque at that point can be maintained, and so called quick response is prevented.

In this way, it is possible to realize the coexistence of both an improvement of responsiveness through a high control gain and an improvement of stability. Furthermore, it is possible to curtail the number of outputs that are introduced from sensors and the various devices which become loads or the like, and this makes possible the simplification of construction.

BRIEF DESCRIPTION OF THE DRAWINGS

Other and further objects, features, and advantages of the invention will be more explicit from the following detailed description taken with reference to the drawings wherein:

FIG. 2 is a block diagram showing the construction of the control apparatus 1 of FIG. 1;

DETAILED DESCRIPTION OF THE PREFERRED EMBODIMENTS

Figure 1:
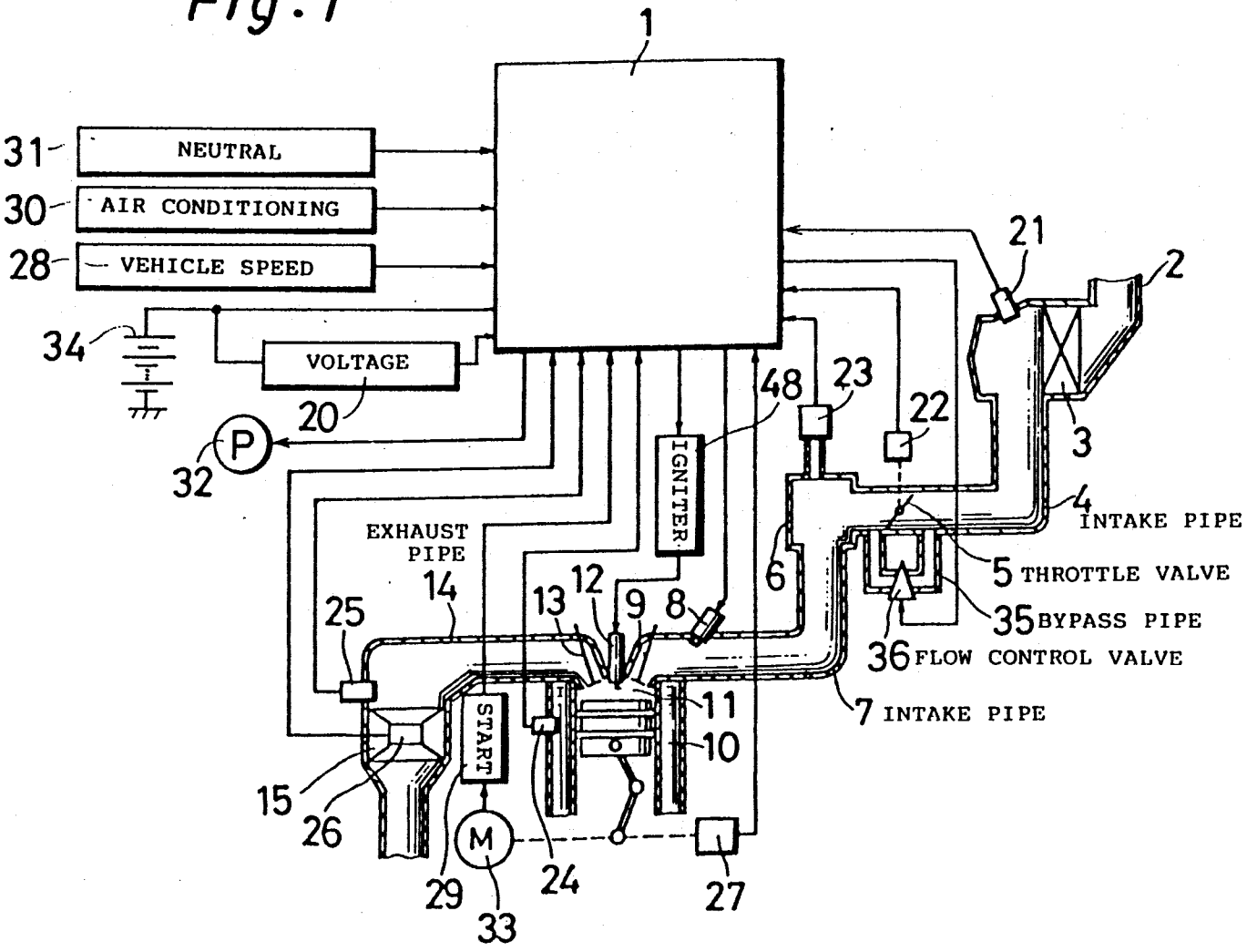
FIG. 1 is a block diagram showing one embodiment of the present invention, a control apparatus 1 for an internal combustion engine; and its related structures.

Now referring to the drawings, preferred embodiments of the invention are described below.

FIG. 1 is a block diagram showing one embodiment of the present invention, a control apparatus 1 for an internal combustion engine, and its related structures. Vacuum air introduced from an intake port 2 is cleansed by an air cleaner 3, and after the inflow is adjusted by a throttle valve 5 which is in an intake pipe 4, it flows into a surge tank 6 via the intake pipe 4. The vacuum air discharged from the surge tank 6 is supplied to a combustion chamber 11 of an internal combustion engine 10 by way of an intake valve 9, after it is mixed with the fuel injected from a fuel injection valve 8 which is in an intake pipe 7. A spark plug 12 is provided in the combustion chamber 11, an exhaust gas from this combustion chamber 11 is discharged via the exhaust valve 13, and is released into an atmosphere from the exhaust pipe 14 through a catalytic converter 15.

An intake temperature sensor 21 which detects the temperature of an intake air is provided in the intake pipe 4. A throttle valve opening sensor 22 is provided in connection with the throttle valve 5, and an intake pressure sensor 23, which detects the pressure of the intake pipe 7, is provided at the surge tank 6. Further, a coolant temperature sensor 24 is provided in the vicinity of the combustion chamber 11. Still further, an oxygen content sensor 25 is provided in the exhaust pipe 14, upstream from the catalytic converter 15, and an exhaust temperature sensor 26 is provided in the catalytic converter 15. The speed of the internal combustion engine 10, that is to say the number of revolutions per unit of time, is detected by a crank angle sensor 27.

Together with the various sensors 21 through 27, detected results from the following sensors are inputted to the control apparatus 1: a vehicle speed sensor 28; a start sensor 29 which detects whether or not a starter motor 33 that starts the internal combustion engine 10 is being activated; an air conditioning sensor 30 which detects the use of an air conditioner; a neutral sensor 31 which detects whether or not a shifted position of the automatic transmission is in the neutral position, when the automobile in which the internal combustion engine 10 is carried has an automatic transmission.

Still further, this control apparatus 1 is electrically energized by a battery 34. The control apparatus 1 calculates, for example, the fuel injection quantity and spark timing based upon the detected results of each of the sensors 21 through 31 and the power supply voltage or the like of the battery 34 detected by the voltage sensor 20, and controls the fuel injection valve 8 and the spark plug 12 or the like.

Further at the intake pipe 4, a bypass pipe 35 is formed which bypasses the upstream side and the downstream side of the throttle valve 5, and the flow control valve 36 is provided in this bypass pipe 35. The flow control valve 36 is duty controlled by the control apparatus 1, and it adjusts and controls the flow of the vacuum air when the throttle valve 5 is almost totally closed during idling. The control apparatus 1 also drives a fuel pump 32 when the internal combustion engine 10 is being run.

FIG. 2 is a block diagram showing the construction of the control apparatus 1. The detected results of the sensors 20 through 25 are supplied to a processing circuit 43 from an input interface circuit 41 via an analog-to-digital converter 42. Furthermore, the detected results of sensors 22 and 27 through 31 are supplied to the processing circuit 43 via an input interface circuit 44. In the processing circuit 43, a memory 45 is provided for storing the various kinds of control maps and learning values or the like. Furthermore, power from the battery 34 is supplied to this processing circuit 43 through a voltage stabilizer 46.

The control output from the processing circuit 43 is brought out through an output interface circuit 47, and is supplied to the fuel injection valve 8, controlling the fuel injection quantity; the control output is further supplied to the spark plug 12 via the igniter 48, thereby controlling the spark timing; still furthermore, the control output is supplied to the flow control valve 36, thereby controlling the intake air flow passing through the idle bypass pipe 35, and the control output also drives the fuel pump 32.

The detected results of the exhaust temperature sensor 26 are supplied to an exhaust temperature detect circuit 49 in the control apparatus 1, and when the detected result indicate an abnormally high temperature, the exhaust temperature detect circuit 49 turns on a warning light 51 via a drive circuit 50.

Figure 3:
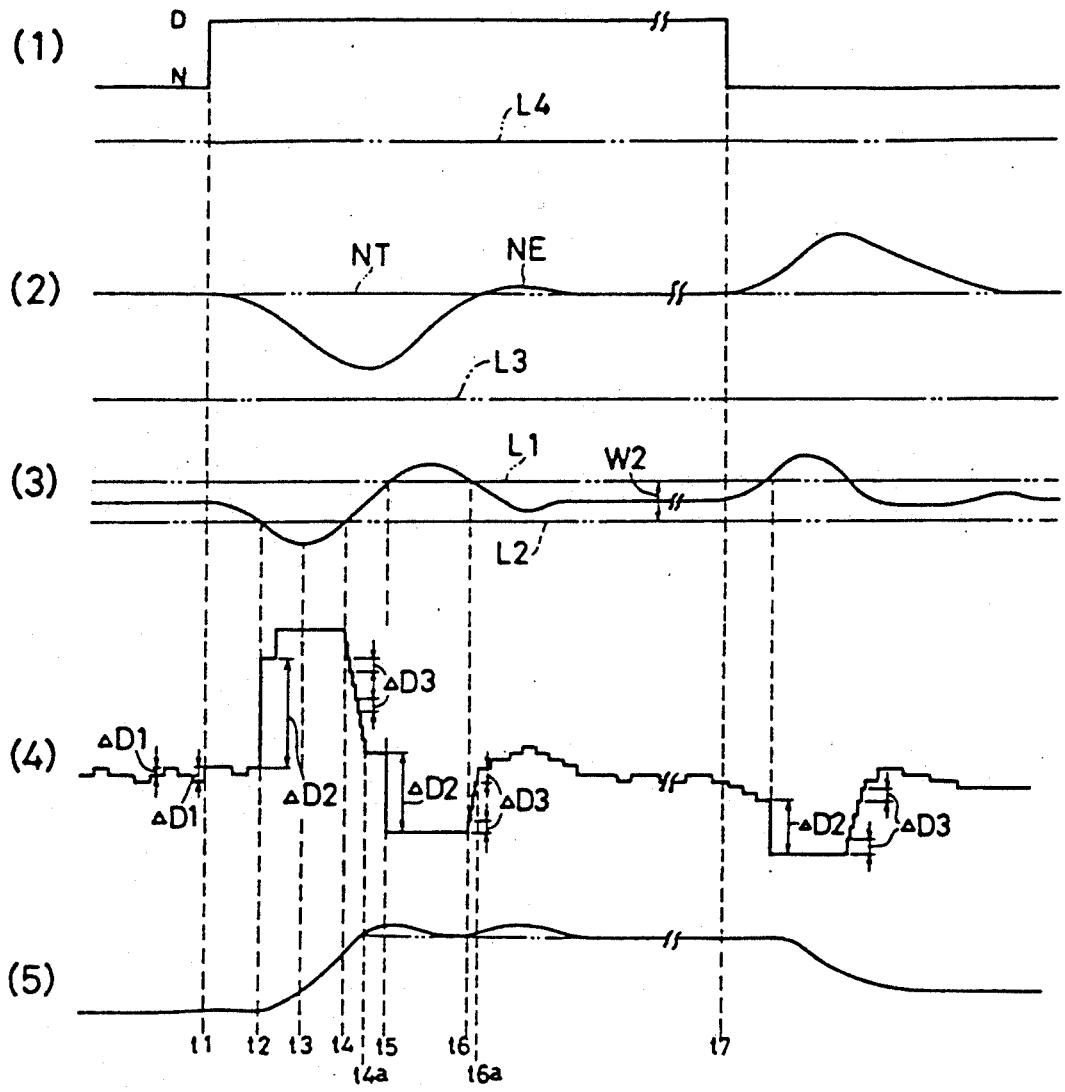
FIGS. 3(1-5) are a timing chart for explaining the idle speed control operation at the time of load fluctuation.

FIG. 3 is a timing chart for explaining the operation of the control apparatus 1 constructed as mentioned above. The control of an air-fuel ratio is performed based on outputs such as that of the oxygen content sensor 25. As is shown in FIG. 3 (2), prior to time t1, when the speed NE of the internal combustion engine 10 is comparatively stable, the control duty of the flow control valve 36, corresponding to the difference between the actual engine speed NE and the target engine speed NT, undergoes integral control by comparatively small additional value ΔD1, as shown in FIG. 3 (4).

Figure 4:
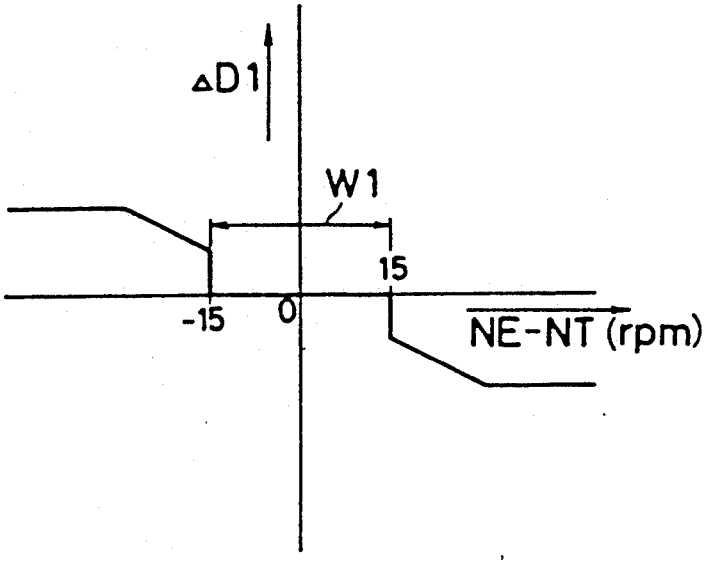
FIG. 4 is a graph showing the change of additional value ΔD1 at the time of regular integral control.

As is shown in FIG. 4, when the difference between the actual engine speed NE and the target engine speed NT is, for example, within an uncontrollable zone, that is, a so called blind sector, W1 of ±15 rpm, the additional value ΔD1 is set to zero, and outside of the dead zone W1, it is set to a value corresponding to the difference NE−NT. In this way at steady times, the engine speed NE is controlled so as to stay within the uncontrollable zone W1.

The target engine speed NT is, for example, set to 700 rpm when there is no load and is set to 950 rpm when the air conditioner is being used.

As is shown in FIG. 3 (1) at time t1, when the shift position of the automatic transmission, which is being sensed by the neutral sensor 31, is changed from the neutral position to the drive position, the load on the internal combustion engine 10 is increased and the engine speed NE begins to drop as is shown in FIG. 3 (2).

Due to this drop, the rate of change per unit of time ΔNE of the engine speed NE shown in FIG. 3 (3) goes below the predetermined threshold value L2, and when the engine speed NE shown in FIG. 3 (2) is less than the threshold value L4, for example just 100 rpm higher than the target engine speed NT, as shown in FIG. 3 (4) at time t2, a comparatively large additional value ΔD2 corresponding to the rate of change ΔNE is added to the calculated value of the control duty for the flow control valve 36. Because of this, the intake pressure $P_M$ of the surge tank 6 rises rapidly and the intake air flow increases, as is shown in FIG. 3 (5).

Figure 5:
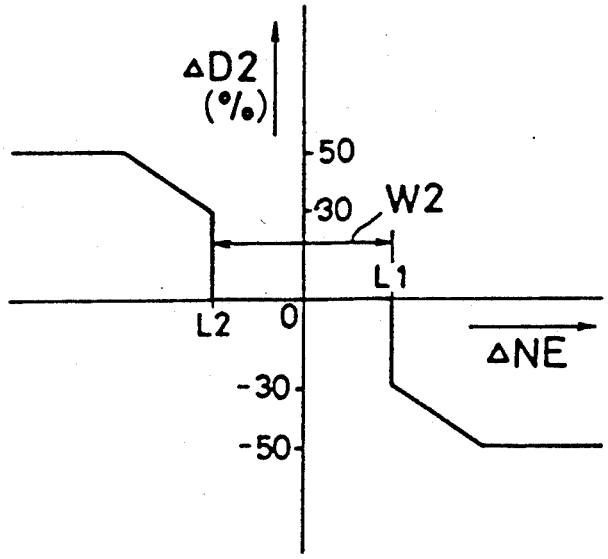
FIG. 5 is a graph showing the change of additional value ΔD2 at the time of quick control.

The relationship of the rate of change ΔNE to the additional value ΔD2 is established at an uncontrollable zone W2 where ΔD2=0, when the rate of change ΔNE is larger than the threshold value L2 on the one side which is smaller than zero, and less than the threshold value L1 on the other side which is larger than zero, as shown in FIG. 5. Furthermore, when the rate of change ΔNE is less than the threshold value L2, and when it is greater than the threshold value L1, the additional value ΔD2 is set corresponding to the rate of change ΔNE. The graph shown in this FIG. 5 and the graph shown in the FIG. 4 are stored in advance as maps within the memory 45.

The drop of the engine speed NE is curtailed by the increase of the intake air flow, and after the rate of change ΔNE passes its minimum state at time t3, then, as shown in FIG. 3 (3), at time t4, the rate of change ΔNE exceeds the threshold value L2 and once again enters the uncontrollable zone W2. In other words, when the rate of change ΔNE comes close to zero, then, as shown in FIG. 3 (4), the calculated value of the control duty is rapidly reduced by repeatedly subtracting the predetermined value ΔD3 until the parameter relating to the intake air flow is nearly equal to the target value α (time t4a), which will be discussed later. Because of this, excesses of control due to a delayed response of the torque generated by the internal combustion engine 10 with respect to the change of control duty are curtailed.

However, even with this control the engine speed NE does not satisfactorily stabilize, and exhibits an increase such as that shown at time t5 where the rate of change ΔNE goes over the threshold value L1, and when the engine speed NE exceeds the threshold value L3, which for example is only 50 rpm lower than the target engine speed NT, the control duty has subtracted the additional value ΔD2 which is proportional to the rate of change ΔNE, as shown in the FIG. 5. In this way, when the rate of change ΔNE enters the uncontrollable zone W2 at time t6, the calculated value of the control duty is rapidly increased by the value ΔD3 until, as previously mentioned, the parameter relating to the intake air flow becomes nearly equal to the target value α (time t6a). And when the intake pressure $P_M$ shown in FIG. 3 (5) stabilizes, integral control is beginning corresponding to the difference between the actual engine speed NE and the target engine speed NT at time t6a.

In this embodiment, the value of the additional value ΔD2 was set to a value proportional to the value of the rate of change ΔNE, but in cases such as when the capacity of the flow control valve 36 is small or the capacity of the surge tank 6 is large, there is no problem in setting the value of the increment ΔD2 to a fixed value. In other words, the same performance can be obtained by control that almost fully opens the flow control valve 36 when the drop of the engine speed NE is detected, or that almost completely closes it when the rise of the engine speed NE is detected.

As is shown after time t7, when the shift position of the automatic transmission is changed to the neutral position, the engine speed NE rises, and is stabilized quickly by the same kind of operation.

Figure 6:
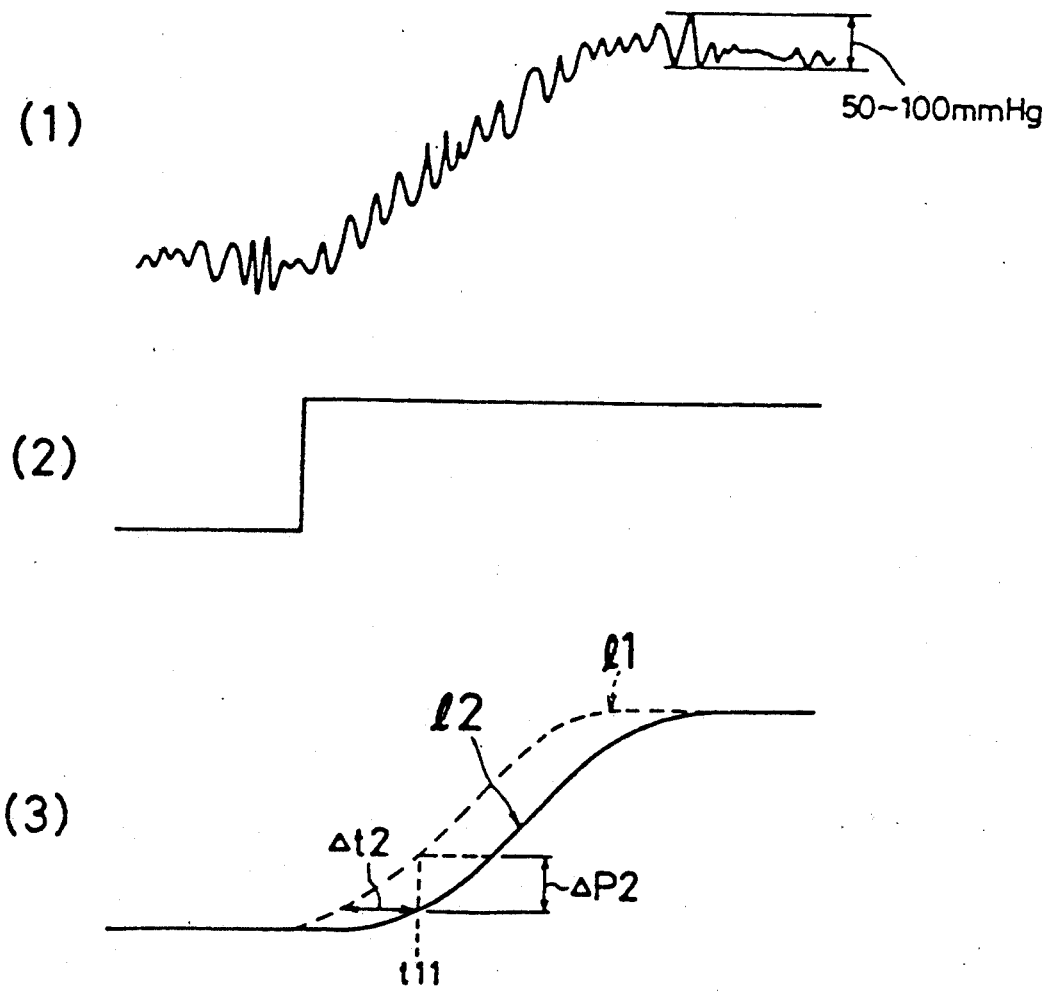
FIGS. 6(1-3) are a timing chart for explaining the operation at the transition time where the control duty DY is changed.

On the other hand, in the detection output of the intake pressure sensor 23 used for the control calculation of the idle speed and fuel injection quantity or the like, fluctuation is caused by the effect of the opening and closing operation of the intake valve 9 as is shown in FIG. 6 (1), and the magnitude of the fluctuation is, for example at 4000 rpm, a large value on the order of 50 to 100 mmHg. In order to absorb this fluctuation and to detect an accurate intake pressure, filter processing is performed within the control apparatus 1 with respect to the detection output of the intake pressure sensor 23.

Accordingly through the delay of this filter processing, even if for example the flow control valve 36 is opened suddenly as shown in FIG. 6 (2), as opposed to the change of the pressure waveform of the actual intake pressure indicated by a numeral l1 in FIG. 6 (3), the pressure waveform after the filter processing is delayed only by a time Δt2 and appears as indicated by a numeral l2.

Therefore, when the control duty is calculated based upon the intake pressure at the calculated timing t11 in FIG. 6 (3), with respect to the intake pressure which originally should have been used for the control duty calculation, only a pressure difference ΔP2 corresponding to the filter processing time Δt2 becomes smaller. For this reason, it anticipates and finds the pressure difference ΔP2 corresponding to the delay in time Δt2, and it is necessary to correct the intake pressure.

As is shown in this FIG. 6 (3), the pressure waveform l2 after filter processing is nearly the same as the pressure waveform l1 of the actual intake pressure, and therefore it is possible to perform a precise correction with respect to this kind of delay by accurately finding the rate of change dP/dt for the intake pressure P.

The rate of change dP/dt is found in the following way. In other words, when the intake air flow to the surge tank 6 is Qin, and the discharge air flow from the surge tank 6 is Qout, $$K1^* \frac{dp}{dt} = Qin - Qout = \Delta Q \quad (1)$$

Provided that ΔQ is the variation of the intake air flow, and K1 is a constant. Furthermore, where the control duty of the flow control valve 36 is DY, and the speed of the internal combustion engine 10 is N, $$Qin = K2^* f(DY) \sqrt{P_o - P} \quad (2)$$

$$Qout = K3^* \eta^* N^* P \quad (3)$$

provided that K2 and K3 are constants, η is intake efficiency, and $P_o$ is atmospheric pressure. Therefore, from the formula (1), the intake pressure P for which the delay correction has been performed is, $$P = Pi + \frac{dp}{dt} {}^*\Delta t2 = Pi + K1a^*\Delta Q^*\Delta t2 \quad (4)$$

provided that Pi is the intake pressure at the calculated timing t11, and Kla=1/K1.

On the other hand, where T is the time required for the revolution of the 180° CA interval of the crank shaft, it becomes, $$P = Pi + K1a*\Delta Q*\frac{1}{\frac{1}{T}}*\frac{1}{T}*\Delta t2 \quad (5)$$

In this formula (5), the time Δt2 is fixed with respect to the time base, and when this is replaced with B, $$P = Pi + K1a*\Delta Q*\frac{1}{N}*N*B \quad (6)$$

In other words, in connection with the delay due to the filter processing, by accurately finding ΔQ, these corrections can be generalized and precise findings made possible.

Figure 7:
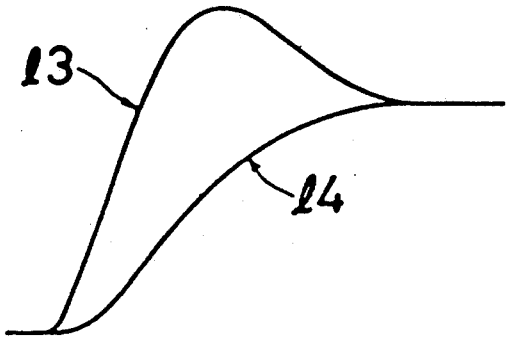
FIG. 7 is a graph showing the relationship of the intake air flow Qin, into a surge tank 6, and the discharge air flow Qout from the surge tank 6.

To continue, the method of calculating ΔQ/N will be explained. The change of the intake air flow Qin when the flow control valve 36 is opened rapidly is as indicated by the a designation 13 in FIG. 7. As opposed to this, due to the effect of the surge tank 6 or the like, the discharge air flow Qout from the surge tank 6 is as indicated by a designation 14. These flows Qin and Qout are expressed by the formula (2) and formula (3) respectively.

Figure 8:
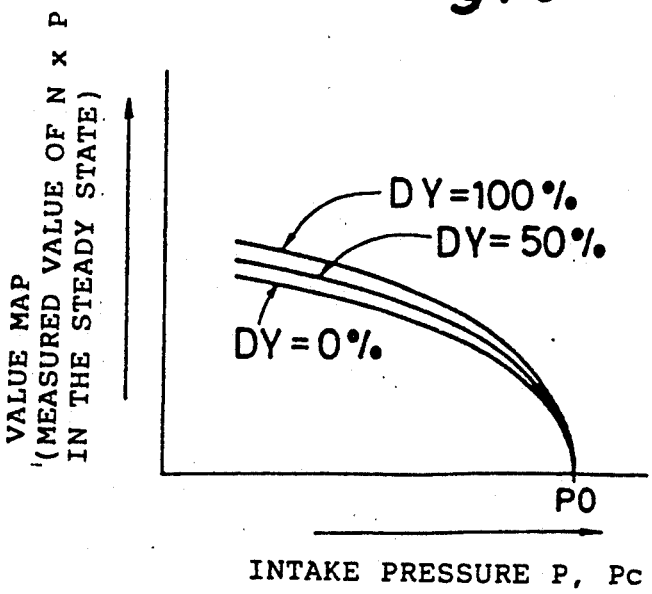
FIG. 8 is a graph showing the change of a value MAP with respect to the change of the intake pressure P, Pc with each control duty DY.

At times of steady running of the internal combustion engine 10, the flow Qin is equal to the flow Qout (Qin=Qout), accordingly, the flow Qout of the steady time is measured by using the control duty DY of the flow control valve 36 and the intake pressure P as the parameter, in result the flow Qin is found out. In other words, a value equivalent to N*P in the formula (3), as shown in FIG. 8, keeps the control duty DY fixed and in the case of a change of the intake pressure P, uses the accumulated value MAP of N and P in each control duty DY. As a result, the flow Qin can be represented as in formula (7). Further, the graph shown in the FIG. 8 is stored as a map in the memory 45.

$$Qin = K3*\eta*MAP \quad (7)$$

Therefore, it can be represented as, $$\frac{\Delta Q}{N} = \frac{Qin}{N} - \frac{Qout}{N} = K3*\eta*\left(\frac{MAP}{N} - P_M\right) \quad (8)$$

However, there are times when MAP/N and $P_M$ in this formula (8) do not match in the steady state at the time of actual control, due to variations in manufacturing, secular change and such of the internal combustion engine 10, and consequently in this embodiment, it is employed replacing the intake pressure $P_M$ with the value Pc found through calculation. Even when a discrepancy arises regarding the intake pressure $P_M$ due to variations or the like mentioned above, the rate of change dP/dt is almost the same, and therefore in the same way as the previously mentioned delay correction expressed in formula (4), it can be expressed as, $$Pci = Pci_{-1} + \frac{dp}{dt}*\Delta t = Pci_{-1} + K1a*\Delta Q*\Delta t \quad (9)$$

-continued $$= Pci_{-1} + K1a*K3*\eta*N*\left(\frac{MAP}{N} - Pci_{-1}\right)*\Delta t$$

provided that Pci is the current calculated value of the value Pc, and $Pci_{-1}$ is the previous calculated value of the value Pc. Therefore, MAP/N and the value Pc found by calculation will certainly match at the steady time, and furthermore, MAP/N changes rapidly together with the change of the control duty DY at the transition time, and the value Pc is matched to this by undergoing follow-up change. Therefore, the value Pc undergoes a successive approximation calculation based on formula (10), for example, every 4 msec.

$$Pc \leftarrow Pc + K5*N*\left(\frac{MAP}{N} - Pc\right) \quad (10)$$

provided that K5=Kla*K3*η.

In the above way, the corrected value Pc is found considering the delay due to the filter processing and variations of the internal combustion engine 10, however, in cases such as when the above delay is small, or when it is desired to perform control more concisely, control is possible even using the actual intake pressure $P_M$ instead of the value Pc.

Figure 9:
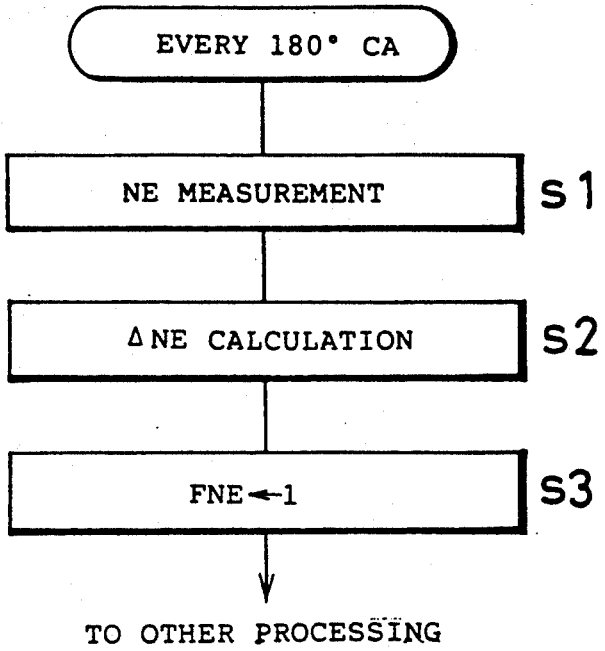
FIGS. 9 through 12 are flow charts for explaining the idle speed control operations.

FIGS. 9 through 12 are flow charts for explaining the above mentioned idle speed control operation. FIG. 9 represents the operation for finding the speed NE of the internal combustion engine 10, and this operation is performed at the timing where there are few errors due to stroke differences in each cylinder of the internal combustion engine 10, for example when there are four cylinders, at each 180° CA. At step s1, the engine speed NE is measured by the crank angle sensor 27, and at step s2, the rate of change ΔNE is calculated from the measurement result at the step s1 and the measurement result from the previous time. At step s3, it sets flag FNE, which indicates the performance of the measurement processing for the engine speed NE, to 1 and moves to another operation.

Figure 10:
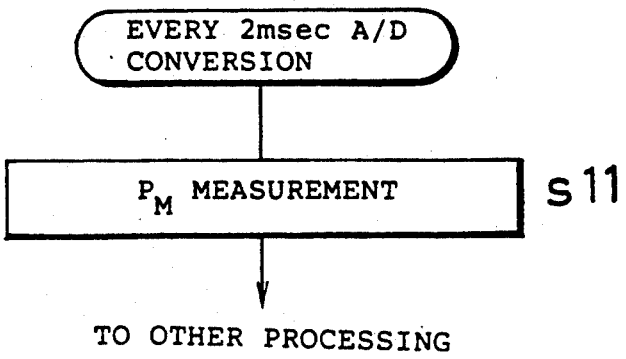

FIG. 10 represents the operation for detecting the intake pressure $P_M$. At step s11, the measurement result of the intake pressure sensor 23 undergoes digital conversion in the analog-to-digital converter 42 and are read into the processing circuit 43. This operation is performed, for example, at each conversion operation which is every 2 msec.

Figure 11:
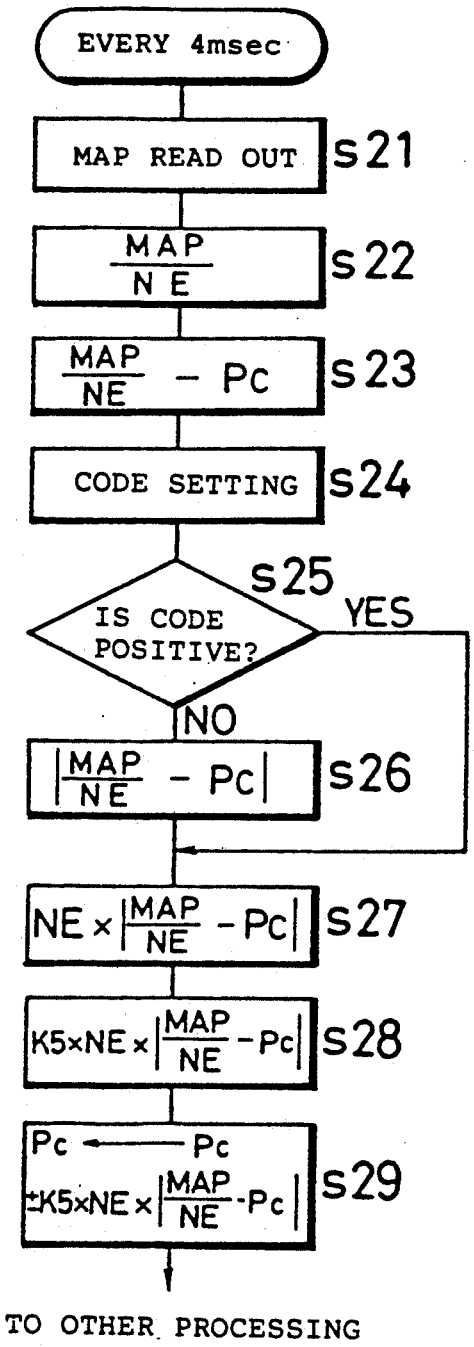

FIG. 11 is a flow chart for explaining the above mentioned approximation calculation and correction calculation, and for example, is performed every 4 msec. At step s21, the map value MAP, based on the graph shown in the FIG. 8, is read out from the control duty DY of the flow control valve 36 and the value Pc found at step s29, which will be discussed later.

At step s22, the value MAP is divided by the engine speed NE, and at step s23, the value Pc is subtracted from the result of that division. At step s24, in correspondence with whether the subtraction result at the step s23 is positive or negative, the code for the approximation calculation of the value Pc at the later mentioned step s29 is set. At step s25, it is determined whether or not the code which was set is positive, and when it is not, it moves to step s27 after the absolute value of the subtraction result at the step s23 is calculated at step s26, and when it is positive, it moves directly to step s27.

At step s27, the subtraction result at the step s23 or step s26 and the engine speed NE are multiplied. At step s28, the calculation result found at step s27 and the coefficient K5 are multiplied. Using this multiplication result, at step s29 the value Pc is replaced based on the code which was set at the step s24. In this way, the approximation calculation of the value Pc indicated in formula (10) is performed. Further as previously mentioned, in case the actual intake pressure $P_M$ is used instead of the value Pc, the operation shown in this FIG. 11 becomes unnecessary.

Figure 12:
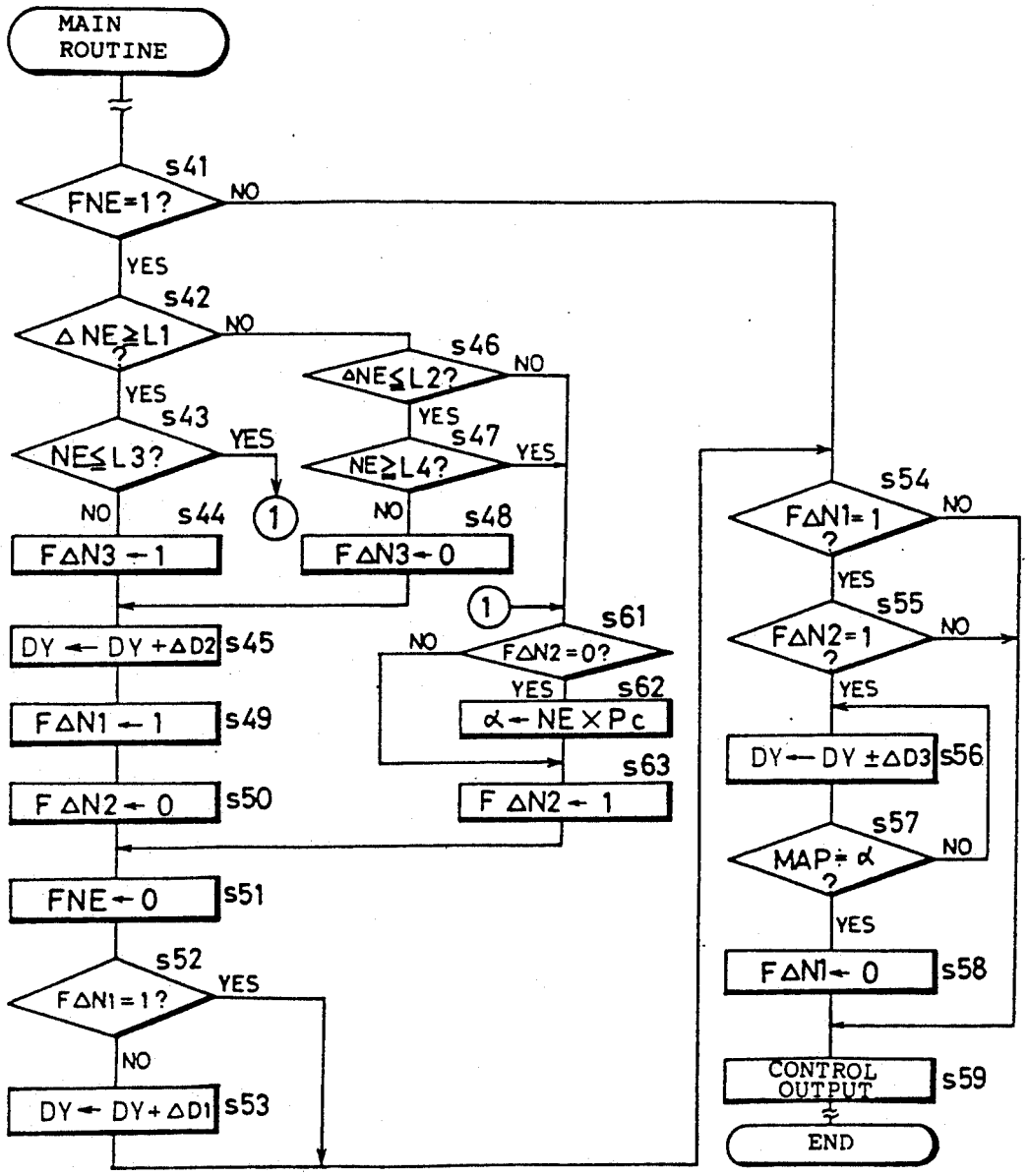

FIG. 12 is a flow chart for explaining the duty control operation of the flow control valve 36 for controlling the idle speed. At step s41, it is determined whether or not the flag FNE is 1, and when it is, that is to say when the measurement processing of the engine speed NE is finished and the predetermined calculation timing has been reached, it moves to step s42. At step s42, it is determined from the calculation result at the step s2 whether or not the rate of change ΔNE is over the threshold value L1, and when it is, that is to say when the engine speed NE is rising, it moves to step s43.

At step s43, it is determined whether or not the engine speed NE measured at the step s1 is below the threshold value L3, which is just 50 rpm lower than the target speed NT, and when it is not, that is to say when it is in the state where control should be implemented, at step s44 the flag FΔN3 that indicates the direction of the change in engine speed NE is set to 1, and indicating that the engine speed NE is rising, then it moves to step s45.

At the step s42, when the rate of change ΔNE is less than the threshold value L1 it moves to step s46, and it is determined whether or not the rate of change ΔNE is below the threshold value L2, and when it is, that is to say when the engine speed NE is dropping, it moves to step s47. At step s47, it is determined whether or not the engine speed NE is above the threshold value L4 which is just 100 rpm higher than the target engine speed NT, and when it is not, that is to say when it is in the state where control should be implemented, at step s48 the flag FΔN3 is reset to zero, and indicating that the engine speed NE is dropping, then it moves to the step s45.

At step s45, the additional value ΔD2 corresponding to the graph shown in the FIG. 5 is read out based on the rate of change ΔNE, and this additional value ΔD2 is added to the control duty DY and then replaced. The kind of rapid control shown at time t2 is performed in this way, then at step s49 the quick control flag FΔN1 that indicates this fact is set to 1, and at step s50, the uncontrollable zone flag ΔN2 is reset to zero, indicating that it is outside of the uncontrollable zone W2 and then it moves to step s51.

Furthermore, at the step s43 and step s47, when it is determined that it is not in the state where rapid control should be implemented, and when it is determined through steps s42 and s46 that the rate of change ΔNE is within the uncontrollable zone W2, it moves to step s61. At step s61, it is determined whether or not the uncontrollable zone flag FΔN2 is 0, and when it is, then at step s62, after the target value α for the timing of return control shown at time t4 in the FIG. 3 is established, it moves to step s63, and when it is not zero, it moves directly to step s63.

In other words, at the point of entering into the uncontrollable zone W2 from outside the uncontrollable zone W2, the target value α which can maintain the torque at that point is established. Furthermore, this target value α is a value related to intake air flow, such as the corrected value Pc of the intake pressure, the intake pressure $P_M$, or the accumulated value of the intake pressure $P_M$ and the engine speed NE, or the accumulated value of the value Pc such as in this embodiment and the engine speed NE. At step s63, after the uncontrollable zone flag FΔN2 is set to 1, it moves to step s51.

At step s51, the flag FNE, which indicates that the measurement processing of the engine speed NE has been performed, is reset to zero. At step s52, it is determined whether or not the quick control flag FΔN1 is 1, and when it is not, that is to say after the quick control has been performed at step s45, then at the time the quick return control is performed by steps s56 and s57, mentioned later, at step s53 the additional value ΔD1 from the graph shown in the FIG. 4 is read out based on the difference between the actual engine speed NE and the target engine speed NT, the control duty DY is replaced by this additional value ΔD1, gentle integral control is performed, and it moves to step s54.

Furthermore, when the flag FNE at the step s41 is not 1, that is to say after the measurement processing of the engine speed NE has been performed, then when the operations shown at the steps s42 through s53 have already been completed, and when the quick control flag FΔN1 at step s52 is 1, that is to say when rapid control is performed at the step s45, it move directly to step s54.

At this step s54, it is determined whether or not the quick control flag FΔN1 is 1, and when it is, then at step s55 it is determined whether or not the uncontrollable zone flag FΔN2 is 1, and when it is, that is to say when inside the uncontrollable zone W2, it moves to step s56. In other words, after quick control is performed by carrying out steps s54 and s55; it moves to step s56 with the calculated timing of the entry into the uncontrollable zone W2.

At step s56, the predetermined value ΔD3 is added to, or subtracted from, the control duty DY corresponding to the flag FΔN3 established at the step s44 or s48. In other words, when flag FΔN3 is 1 the value ΔD3 is added, and when flag FΔN3 is zero the value ΔD3 is subtracted, and in this way the control duty DY is replaced.

At step s57, the value MAP from the graph shown in the FIG. 8 is read out based on the control duty DY which was replaced at step s56 and the corrected value Pc of the intake pressure, then it is determined whether or not this value MAP is nearly equal to the target value α which was established at the step s62, and when it is not steps s56 and s57 are repeated, and in this way when it becomes nearly equal to the target value α it moves to step s58.

At step s58, after the quick control flag FΔN1 is reset to zero it moves to step s59, and the opening degree control of the flow control valve 36 is actually performed by the control duty DY which was found at the above mentioned steps s45 and s53 or s56.

To summarize the above operations, when the engine speed NE rapidly drops or rises, the control duty DY is rapidly changed by just the additional value ΔD2 which corresponds to the rate of change ΔNE, by means of the operations of steps s42, s43, s44, and s45, or steps s42, s46, s47, s48, and s45. After performing this kind of rapid control, at the time of entry into the uncontrollable zone W2, rapid return control is performed by the value ΔD3 in the direction of the target value α, with the steps s54 through s57 which are supposed to maintain the target value α at that point, and excesses of control are prevented. When in this way the engine speed NE stabilizes, regular integral control is performed by step s53, and with a small gain stable control is performed.

In this way with the control apparatus 1 conforming to the invention, when a rapid drop in the engine speed NE due to load fluctuation was detected, the control duty DY of the flow control valve 36 is changed by just the additional value ΔD2 in response to the rate of change ΔNE of the engine speed NE, and the drop is quickly curtailed. Furthermore when the drop of the engine speed NE is restored, because it is made so that the control duty DY is rapidly reduced by predetermined value ΔD3 in the direction of the target value α for intake air flow at that point, it is possible to ensure favorable stability without resulting in overcontrol such as a large control gain and the occurrence of quick response.

Furthermore, also in cases where the engine speed NE rises due to load fluctuation, in the same way together with a quick curtailing of quick response it is possible to reliably prevent engine stalling due to overcontrol, and in this way it is possible to perform idle speed control combining both responsiveness and stability.

Still furthermore, because the threshold values L3 and L4 are set close to the target engine speed NT, and rapid control with the additional value ΔD2 is such that it is performed when the measured engine speed NE is higher than the threshold value L3 while rising, or when it is less than the threshold value L4 while dropping, unnecessary control is prevented and through this it is possible to further improve stability.

Furthermore, by improvement of responsiveness with respect to load fluctuation in this way, it is possible to limit to a minimum requirement the various device outputs and sensor measurement results or the like which need to be introduced to the control apparatus 1, and because of this it is possible to simplify construction.

The invention may be embodied in other specific forms without departing from the spirit or essential characteristics thereof. The present embodiments are therefore to be considered in all respects as illustrative and not restrictive, the scope of the invention being indicated by the appended claims rather than by the forgoing description and all changes which come within the meaning and the range of equivalency of the claims are therefore intended to be embraced therein.

What is claimed is:

1. An idle speed control apparatus for an internal combustion engine having a means for linking an upstream side and a downstream side of a throttle valve with an idle bypass pipe, and a means for maintaining the engine speed at a predetermined target speed by changing an opening degree of a flow control valve provided in the idle bypass pipe, wherein:

when a drop of the engine speed is detected, said means for maintaining the engine speed includes a means for increasing the opening degree at a comparatively high rate of change; and, at a point that the rate of change of the engine speed approaches zero, said means for maintaining the engine speed includes a means for setting a value related to at least one of an intake pipe pressure and an accumulated value of the intake pipe pressure and the engine speed at that point as a target value, and for rapidly decreasing the opening degree of the flow control valve to at least one of either maintaining the target value, and, alternatively, until the target value is reached at a range where a gentle change of the engine speed is possible.

2. The idle speed control apparatus for an internal combustion engine as claimed in claim 1, wherein the increasing of the opening degree of the flow control valve to the detection of the drop of the engine speed is performed by said means for maintaining the engine speed at a time when the engine speed is near the target speed and is lower than a predetermined first value which is higher than the target speed.

3. An idle speed control apparatus for an internal combustion engine having a means for linking an upstream side and a downstream side of a throttle valve with an idle bypass pipe, and a means for maintaining the engine speed at a predetermined target speed by changing an opening degree of a flow control valve provided in the idle bypass pipe, wherein:

when a rise of the engine speed is detected, said means for maintaining the engine speed includes means for decreasing the opening degree at a comparatively high rate of change; and, at a point that the rate of change of the engine speed approaches zero, said means for maintaining the engine speed includes a means for setting a value related to at least one of an intake pipe pressure and an accumulated value of the intake pipe pressure and the engine speed at that point as a target value, and for rapidly increasing the opening degree of the flow control valve to at least one of either maintaining the target value, and, alternatively, until the target value is reached at a range where a gentle change of the engine speed is possible.

4. The idle speed control apparatus for a internal combustion engine as claimed in claim 3, wherein the decreasing of the opening degree of the flow control value due to the detection of the rise of the engine speed is performed by said means for maintaining the engine speed at a time when the engine speed is near the target speed and is higher than a predetermined second value which is lower than the target speed.

* * * * *